US007091804B2

(12) United States Patent
Aramaki et al.

(10) Patent No.: US 7,091,804 B2
(45) Date of Patent: Aug. 15, 2006

(54) ROTARY JOINT

(75) Inventors: Yoji Aramaki, Tokyo (JP); Naofumi Yoneda, Tokyo (JP); Moriyasu Miyazaki, Tokyo (JP); Akio Iida, Tokyo (JP); Izuru Naito, Tokyo (JP); Toshiyuki Horie, Tokyo (JP); Yutaka Simawaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 18 days.

(21) Appl. No.: 10/475,332

(22) PCT Filed: Mar. 25, 2003

(86) PCT No.: PCT/JP03/03631

§ 371 (c)(1),
(2), (4) Date: Oct. 21, 2003

(87) PCT Pub. No.: WO03/083987

PCT Pub. Date: Oct. 9, 2003

(65) Prior Publication Data

US 2004/0135657 A1 Jul. 15, 2004

(30) Foreign Application Priority Data

Apr. 2, 2002 (JP) ..... 2002-099537

(51) Int. Cl.
*H01P 1/06* (2006.01)

(52) U.S. Cl. ..... 333/257; 333/261; 333/21 A; 333/21 R

(58) Field of Classification Search ..... 333/257, 333/261, 21 A, 21 R
See application file for complete search history.

(56) References Cited

U.S. PATENT DOCUMENTS

| | | | | |
|---|---|---|---|---|
| 2,686,901 | A * | 8/1954 | Dicke | 333/21 R |
| 2,714,707 | A * | 8/1955 | Zabel | 333/21 R |
| 2,892,982 | A * | 6/1959 | Allen | 333/117 |
| 2,965,898 | A * | 12/1960 | Lewis | 342/365 |
| 3,715,688 | A * | 2/1973 | Woodward | 333/1 |
| 4,492,938 | A * | 1/1985 | Young | 333/111 |
| 4,847,574 | A * | 7/1989 | Gauthier et al. | 333/21 A |
| 6,150,899 | A * | 11/2000 | Seewig et al. | 333/126 |
| 6,388,537 | B1 * | 5/2002 | Matsumoto | 333/21 A |
| 6,489,855 | B1 * | 12/2002 | Kitamori et al. | 333/21 R |

FOREIGN PATENT DOCUMENTS

| | | |
|---|---|---|
| JP | 53-53239 A | 5/1978 |
| JP | 56-51522 B2 | 12/1981 |
| JP | 59-62226 A | 4/1984 |

(Continued)

*Primary Examiner*—Robert Pascal
*Assistant Examiner*—Kimberly E Glenn
(74) *Attorney, Agent, or Firm*—Birch, Stewart, Kolasch & Birch, LLP

(57) ABSTRACT

The present invention aims at providing a rotary joint which is of a thin type and has broad band characteristics and which is low in loss and is excellent in power resistance as well. In order to attain the object, the rotary joint includes: first and second polarizers each having a common side terminal connected to a waveguide portion, and two branch side terminals through which two polarized waves orthogonal to each other inputted through the common side terminal are separately taken out; and the waveguide portion which has a rotatable connection portion, one end of which is connected to the common side terminal of the first polarizer and the other end of which is connected to the common side terminal of the second polarizer.

15 Claims, 12 Drawing Sheets

FOREIGN PATENT DOCUMENTS

| | | | | |
|---|---|---|---|---|
| JP | 59-44801 | B2 | | 11/1984 |
| JP | 60058701 | | * | 4/1985 |
| JP | 62-51801 | A | | 3/1987 |
| JP | 6-85502 | A | | 3/1994 |
| JP | 10-32406 | A | | 2/1998 |
| JP | 11-330801 | A | | 11/1999 |
| JP | 2001-345602 | A | | 12/2001 |
| WO | WO 03/083987 | A1 | | 10/2003 |

* cited by examiner

ROTARY JOINT

This application is the national phase under 35 U.S.C. § 371 of PCT International Application No. PCT/JP03/03631 which has an International filing date of Mar. 25, 2003, which designated the United States of America.

TECHNICAL FIELD

The present invention relates to a rotary joint mainly used in a VHF band, a UHF band, a microwave band and a millimeter band.

BACKGROUND ART

FIG. 12 is a plan view showing a construction of a conventional rotary joint shown in JP 56-51522 B for example. In FIG. 12, reference numerals 101 and 102 respectively designate circular waveguides which are nearly identical in cross sectional size to each other and to which an interval axis is nearly common; reference numeral 103 designates a choke groove which is formed in a flange portion of a connection surface between the circular waveguides 101 and 102; reference numeral 104 designates a bearing; reference numeral 105 designates a connection portion consisting of the choke groove and the bearing; reference numerals 106 and 107 respectively designate projection portions for conversion from a linearly polarized wave to a circularly polarized wave; reference numerals 108 and 109 respectively designate input rectangular waveguides; reference numerals 110 and 111 respectively designate output rectangular waveguides; reference numerals 112 and 113 respectively designate short-circuit plates; and reference numerals 114 to 117 respectively designate coupling holes.

The choke groove 103 is the means which is usually used so that a gap defined between the circular waveguides 101 and 102 becomes equivalently short-circuit in a frequency of an electric wave propagated through the circular waveguides 101 and 102. The circular waveguides 101 and 102 are connected to each other in terms of a high frequency by a function of the connection portion 105 having the choke groove 105 while keeping a predetermined gap therebetween. The circular waveguide 102 can be rotated about a tube axis with respect to the circular waveguide 102 by a predetermined angle of rotation by a function of the bearing 104 while keeping the tube axis so that the circular waveguides 101 and 102 are aligned with each other through the tube axis.

The position of the projection portion 106 for conversion from a linearly polarized wave to a circularly polarized wave is set to the position making an angle of +45 degrees or −45 degrees with a direction of an electric field of a TE10-mode of the input rectangular waveguide 108. At this time, the position of the projection portion 107 for conversion from a linearly polarized wave to a circularly polarized wave is set to the position which, for the former, makes an angle of −45 degrees with a direction of an electric field of a TE10-mode of the output rectangular waveguide 110, and which, for the latter, makes an angle of +45 degrees. The coupling holes 114 and 116 are formed by cutting off parts of the short-circuit plates 112 and 113, respectively. The coupling holes 115 and 117 are formed by cutting off parts of sidewalls of the circular waveguides 101 and 102, respectively.

Next, operation will hereinbelow be described. After an electric wave of a TE10-mode made incident from the input rectangular waveguide 108 has been efficiently converted into the electric wave of a TE11-mode in the circular waveguide 101 through the coupling hole 114 now, it is then converted from the linearly polarized wave into the circularly polarized wave by the projection portion 106 for conversion from a linearly polarized wave into a circularly polarized wave. The circularly polarized wave obtained through the conversion is transmitted to the circular waveguide 102 through the connection portion 105 irrespective of an angle of rotation of the circular waveguide 102 due to the rotation symmetry of the mode to be guided into the output rectangular waveguide 110 through a course reverse to the above-mentioned course. That is to say, after the electric wave has been converted from the circularly polarized wave into the linearly polarized wave by the projection portion 107 for conversion from a linearly polarized wave into a circularly polarized wave in the circular waveguide 102, it is then transmitted to the output rectangular waveguide 110 through the coupling hole 116.

On the other hand, other electric waves of a TE10-mode made incident from the input rectangular waveguide 109 is efficiently converted into the electric wave of a TE11-mode in the circular waveguide 101 through the coupling hole 115. At this time, a direction of the electric field of the TE11-mode obtained through the conversion perpendicularly intersects that of the TE11-mode due to the incident wave from the input rectangular waveguide 108. For this reason, the electric wave of the TE11-mode obtained through the conversion via the coupling hole 115 is converted into a circularly polarized wave having rotation reverse to that of the TE11-mode through the coupling hole 114 by the projection portion 106 for conversion from a linearly polarized wave into a circularly polarized wave. At this time, the circularly polarized wave obtained through the conversion is transmitted to the circular waveguide 102 through the connection portion 105 irrespective of an angle of rotation of the circular waveguide 102 due to the rotation symmetry of the mode to be guided to the output rectangular waveguide 111 through a course reverse to the above-mentioned course. That is to say, after the electric wave has been converted from the circularly polarized wave into the linearly polarized wave by the projection portion 107 for conversion from a linearly polarized wave into a circularly polarized wave in the circular waveguide 102, it is then transmitted to the output rectangular waveguide 111 through the coupling hole 117.

As described above, in the conventional rotary joint shown in FIG. 12, a signal within the input rectangular waveguide 108, and a signal within the input rectangular waveguide 109 are respectively guided to the output rectangular waveguide 110 and the output rectangular waveguide 111 irrespective of presence or absence of the rotation of the circular waveguide 102 and the output rectangular waveguide 110. That is to say, the conventional rotary joint has a function as a two-channel rotary joint which is capable of transmitting different two signals at the same time.

In the conventional rotary joint, for obtaining a circularly polarized wave having excellent axial ratio characteristics, the projection portions 106 and 107 for conversion from a linearly polarized wave into a circularly polarized wave need to be provided so as to be relatively long. Thus, there is encountered a problem in that the total length becomes long.

In addition, in general, in the projection portions 106 and 107 for conversion from a linearly polarized wave into a circularly polarized wave, a frequency range in which a circularly polarized wave with excellent axial ratio characteristics is obtained is relatively narrow. Thus, there is encountered a problem in that the excellent axial ratio characteristics of a broad band are difficult to be obtained for a rotary joint as well.

The present invention has been made in order to solve the above-mentioned problems, ant it is, therefore, an object of the present invention to provide a rotary joint which is of a thin type and has broad band characteristics and which is low in loss and is excellent in power resistance.

DISCLOSURE OF THE INVENTION

A rotary joint according to the present invention includes: first and second polarizers each having a common side terminal connected to a waveguide portion, and two branch side terminals through which two polarized waves orthogonal to each other inputted through the common side terminal are separately taken out; and the waveguide portion which has a rotatable connection portion, one end of which is connected to the common side terminal of the first polarizer and the other end of which is connected to the common side terminal of the second polarizer.

BEST MODE FOR CARRYING OUT THE INVENTION

FIRST EMBODIMENT

Figure 1:
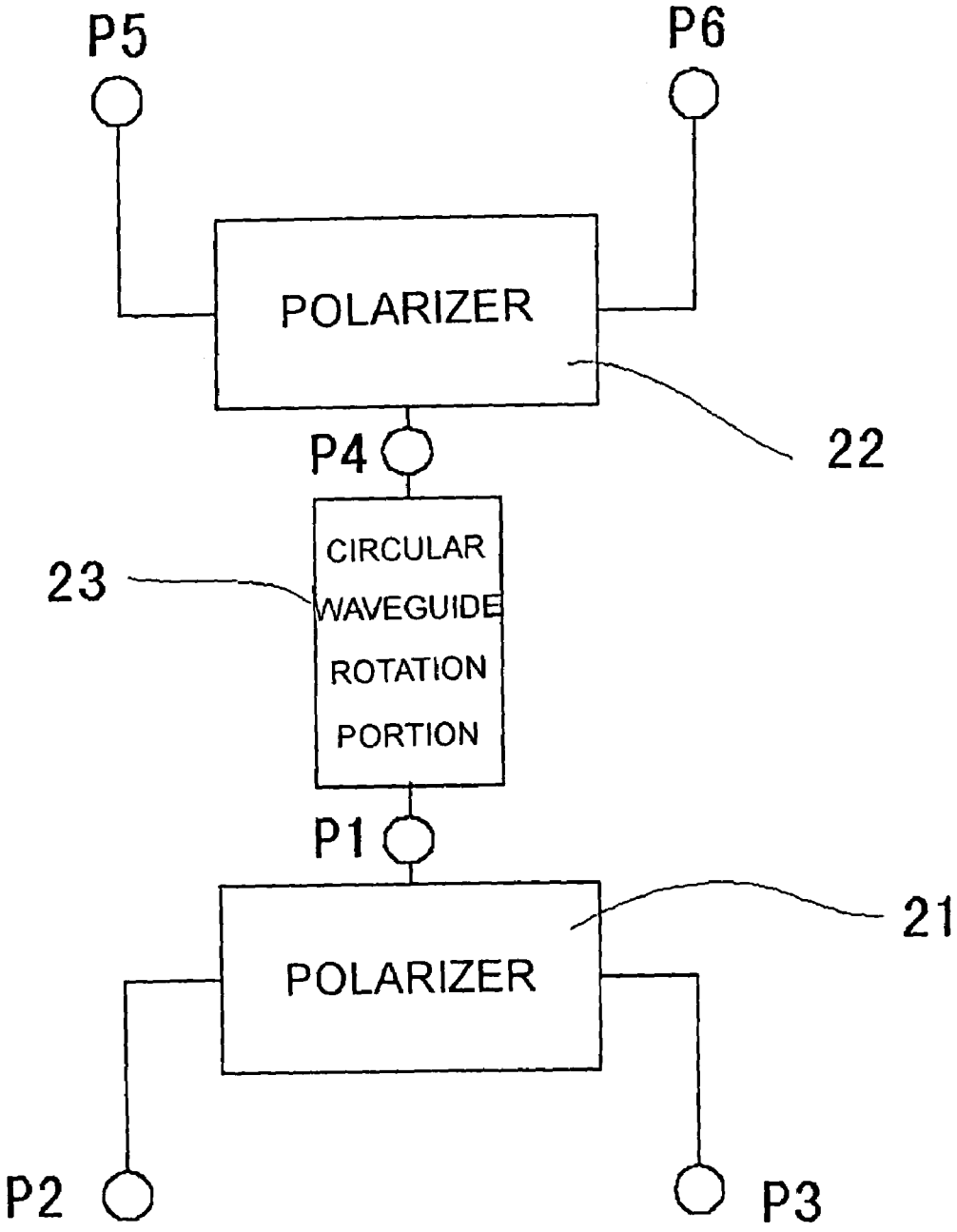
FIG. 1 is a structural view of a rotary joint according to A first embodiment of the present invention.

FIG. 1 is a structural view of a rotary joint according to A first embodiment of the present invention. In FIG. 1, reference numerals 21 and 22 respectively designate polarizers, reference numeral 23 designates a circular waveguide rotation portion having a rotatable construction, and reference symbols P1 to P6 respectively designate terminals. Polarizers having the same construction are used as the polarizers 21 and 22. The polarizer 21 has a common side terminal P1 having a circular waveguide cross sectional shape, and two branch side terminals P2 and P3 through which two polarized waves orthogonal to each other inputted to the common side terminal P1 are separately taken out. Likewise, the polarizer 22 has a common side terminal P4 having a circular waveguide cross sectional shape and two branch side terminals P5 and P6 through which two polarized waves orthogonal to each other inputted to the common side terminal P4 are separately taken out. One end of the circular waveguide rotation portion 23 is connected to the common side terminal P1 of the polarizer 21, and the other end thereof is connected to the common side terminal P4 of the polarizer 22. The construction of the polarizers 21 and 22 is shown in FIG. 2 to FIG. 4, and the construction of the circular waveguide rotation portion 23 is shown in FIG. 5.

Figure 2:
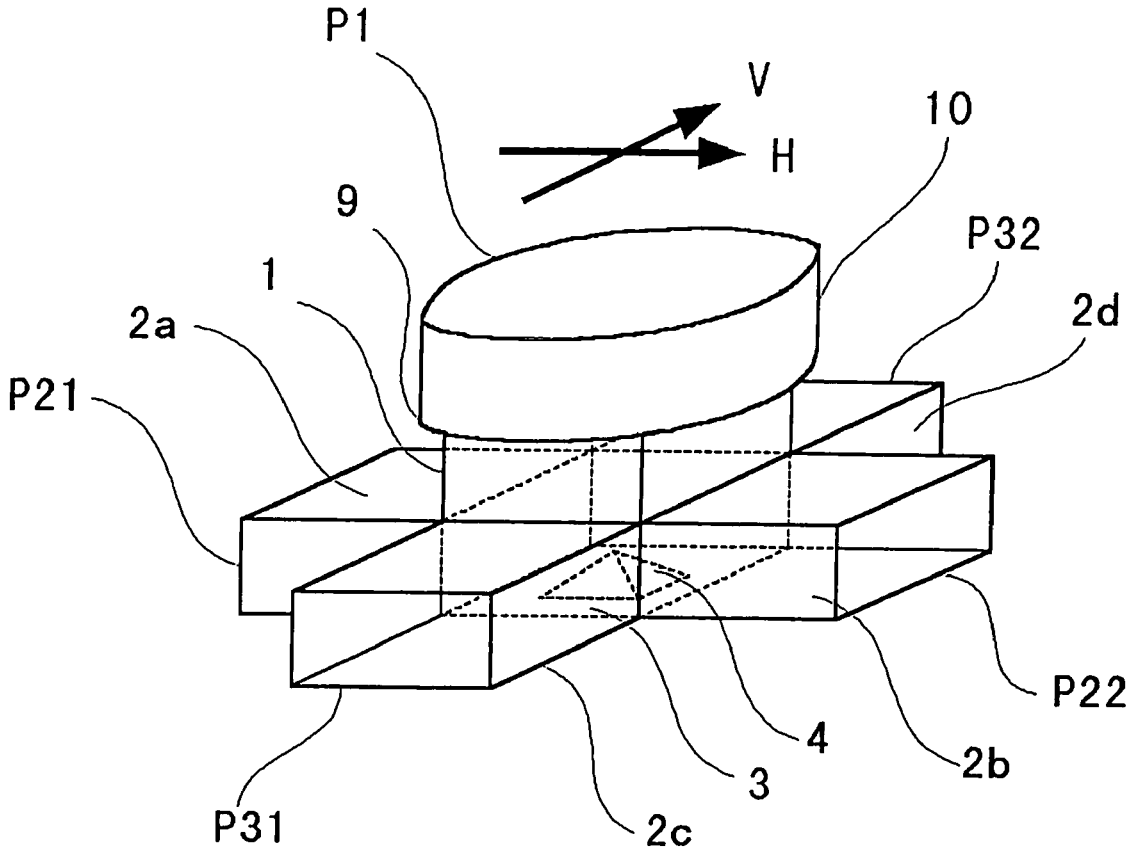
FIG. 2 is a perspective view showing a part of the rotary joint according to the first embodiment of the present invention.

FIG. 2 is a perspective view showing a part of the rotary joint according to the first embodiment of the present invention. FIG. 2 shows a part of the polarizer 21(22). In FIG. 2, reference numeral 1 designates a first square main waveguide through which a vertically polarized wave and a horizontally polarized wave are transmitted; reference numerals 2*a* to 2*d* respectively designate first to fourth rectangular branch waveguides branching perpendicularly and symmetrically with respect to a tube axis of the square main waveguide 1; reference numeral 3 designates a short-circuit plate shutting one terminal of the square main waveguide 1; reference numeral 4 designates a quadratic spindle-shaped metallic block which is provided within the square main waveguide 1 and on the short-circuit plate 3; reference numeral 9 designates a circular-square waveguide step which is connected to one terminal of the square main waveguide 1, an opening diameter of which becomes smaller towards a branch portion of the first square main waveguide 1 for the first to fourth rectangular branch waveguides 2*a* to 2*d*, and a stepped portion of which is much smaller than a free-space wavelength of a used frequency band; reference numeral 10 designates a circular main waveguide which is connected to the circular-square waveguide step 9 and through which a vertically polarized electric wave and a horizontally polarized electric wave are transmitted; reference symbols P21, P22, P31 and P32 respectively designate terminals; reference symbol H designates the horizontally polarized electric wave; and reference symbol V designates the vertically polarized electric wave.

Figure 3:
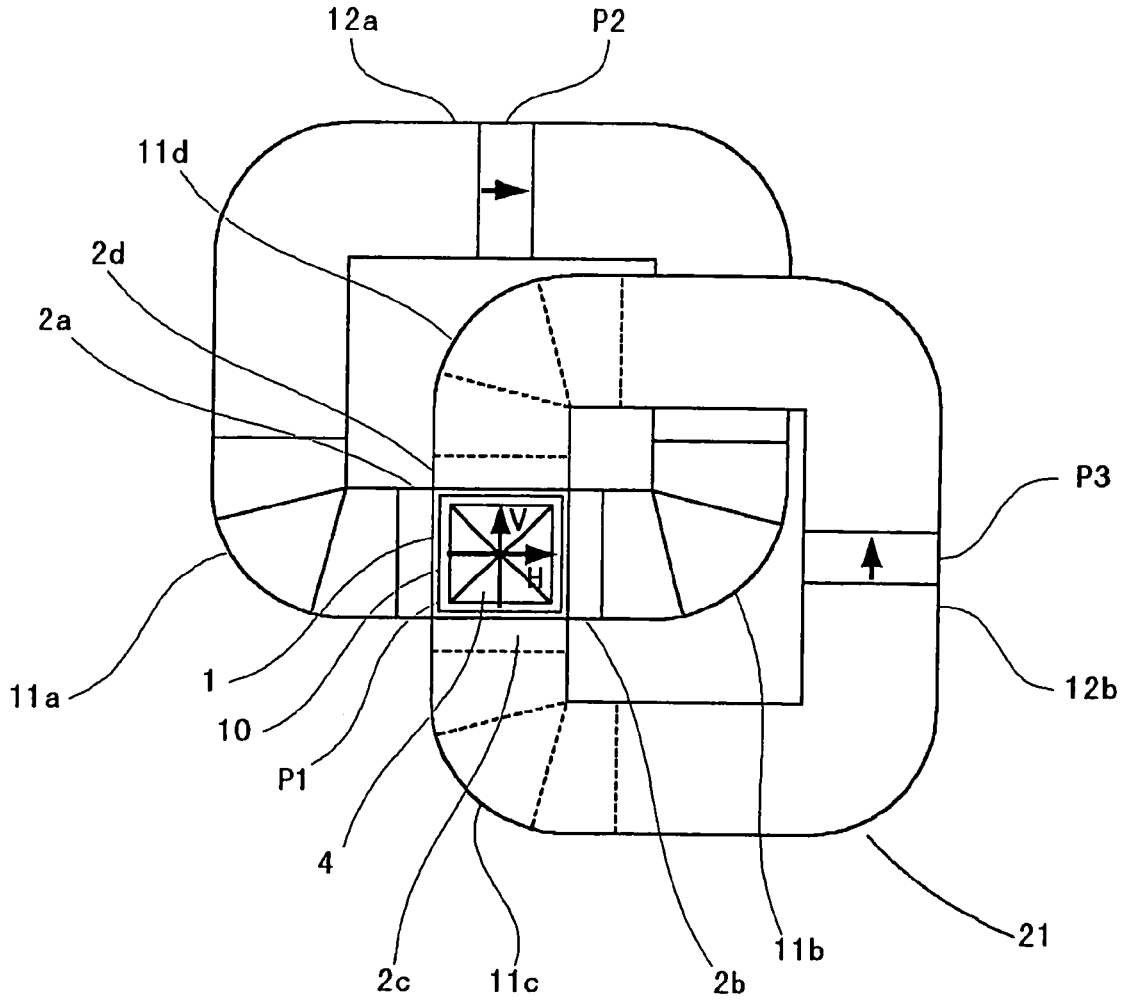
FIG. 3 is a plan view showing a part of the rotary joint according to the first embodiment of the present invention.
Figure 4:
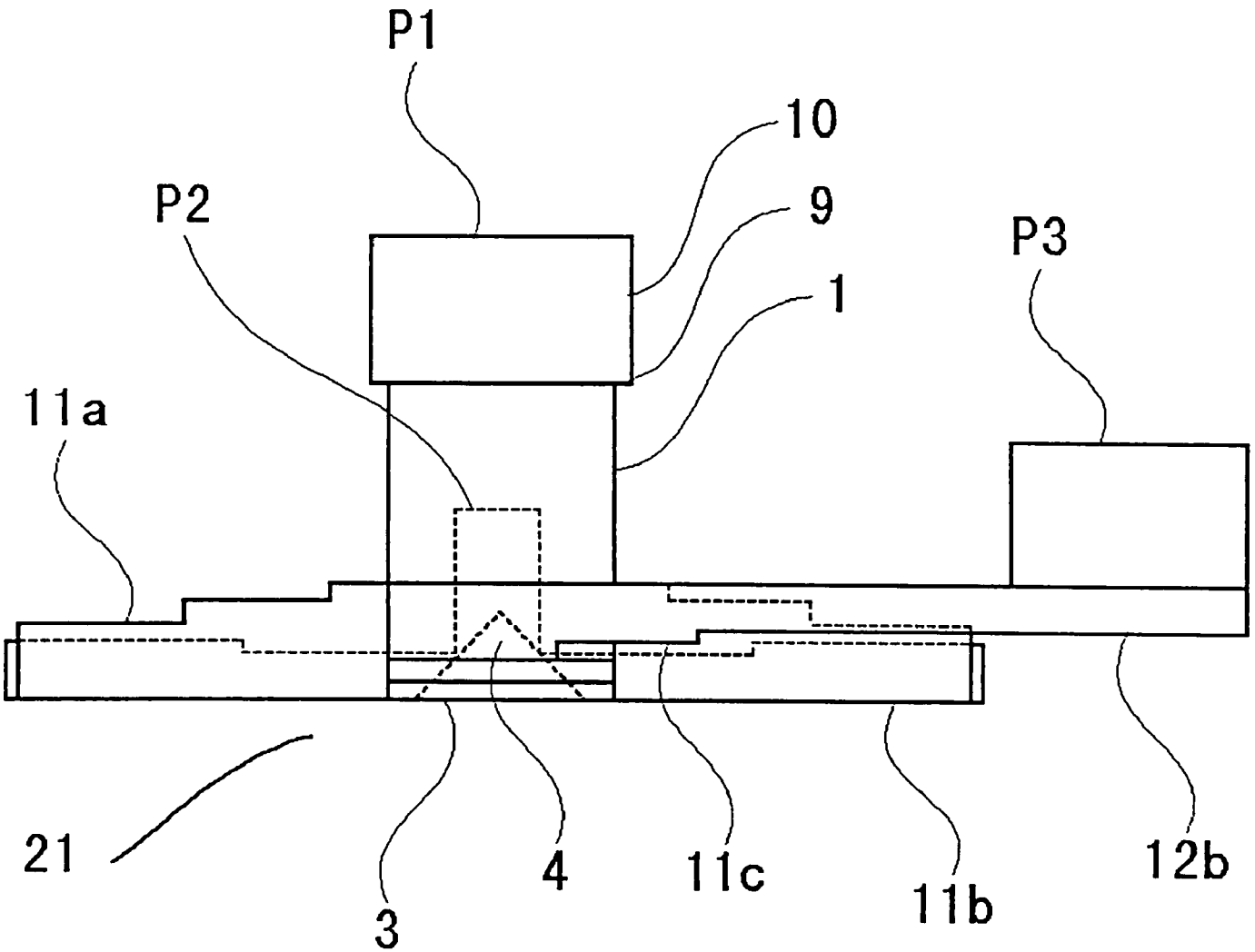
FIG. 4 is a plan view showing a part of the rotary joint according to the first embodiment of the present invention.

FIG. 3 and FIG. 4 respectively are plan views each showing a part of the rotary joint according to the first embodiment of the present invention. FIG. 3 and FIG. 4 show the polarizer 21(22) in which the construction of FIG. 2 is used. In FIG. 3 and FIG. 4, reference numerals 11*a* to 11*d* respectively designate first to fourth rectangular waveguide multistage transformers which are connected to the first to fourth rectangular branch waveguides 2*a* to 2*d*, respectively, and tube axes of which are curved at H-planes thereof and opening diameters of which become smaller as they become apart from the respective rectangular branch waveguides 2*a* to 2*d*; reference numeral 12*a* designates a first rectangular waveguide E-plane T-branch circuit which is connected to the first rectangular waveguide multistage transformer 11*a* and the second rectangular waveguide multistage transformer 11*b*; and reference numeral 12*b* designates a second rectangular waveguide E-plane T-branch circuit which is connected to the third rectangular waveguide multistage transformer 11*c* and the fourth rectangular waveguide multistage transformer 11*d*.

Figure 5:
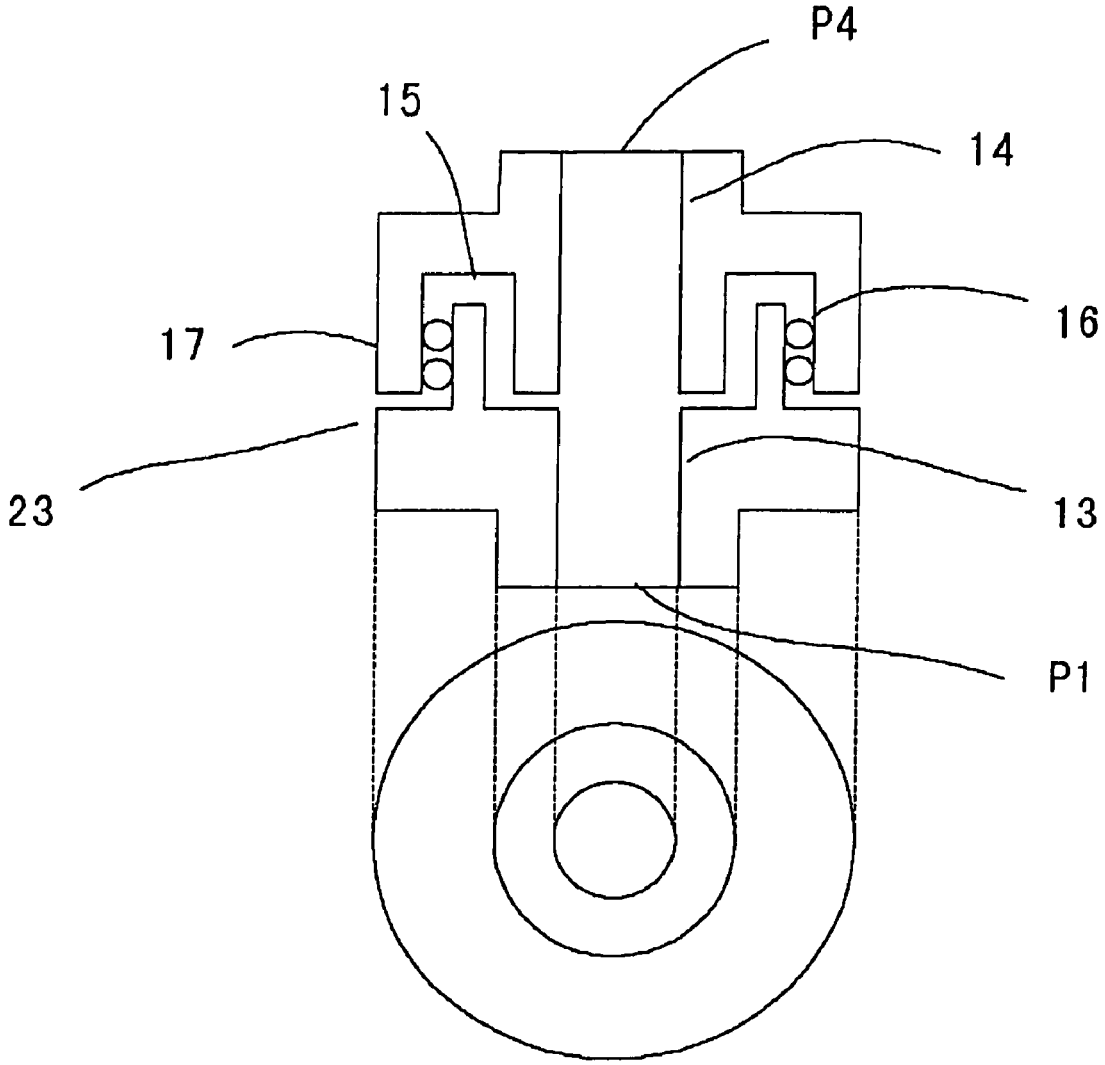
FIG. 5 is a plan view showing a part of the rotary joint according to the first embodiment of the present invention.

FIG. 5 is a plan view showing a part of the rotary joint according to the first embodiment of the present invention. FIG. 5 shows the circular waveguide rotation portion 23. In FIG. 5, reference numerals 13 and 14 respectively designate circular waveguides; reference numeral 15 designates a choke groove which is formed in a flange portion of a connection surface between the circular waveguides 13 and 14; reference numeral 16 designates a bearing; and reference numeral 17 designates a connection portion consisting of the choke groove and the bearing.

Description will hereinbelow be given with respect to the operation of the rotary joint according to the first embodiment of the present invention with reference to FIG. 1 to FIG. 5. First of all, in FIG. 2, assuming that the horizontally polarized electric wave H of a basic mode (TE01-mode) is inputted through the terminal P1, this electric wave is propagated through the circular-square waveguide step 9, the square main waveguide 1, and the rectangular branch waveguides 2*a* and 2*b* to be outputted as the electric wave of a basic mode (TE10-mode) in each branch waveguide through the terminals P21 and P22.

Figure 6:
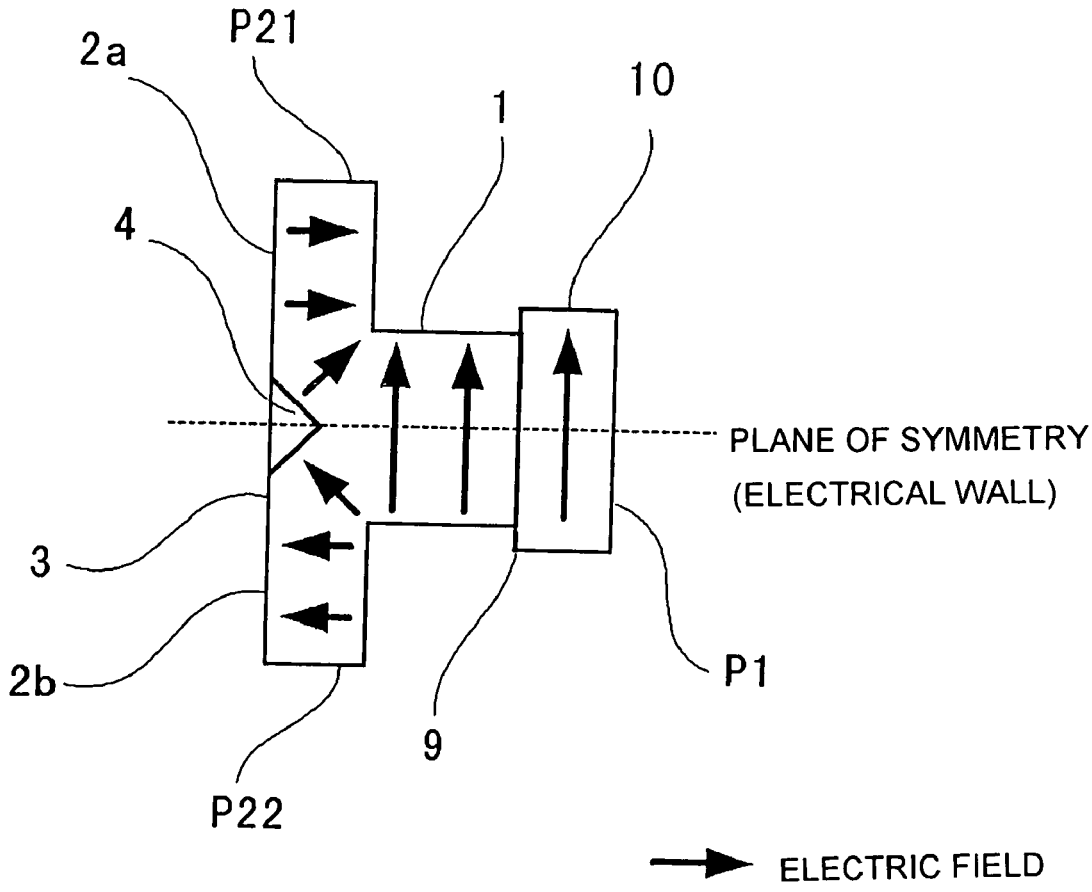
FIG. 6 is a diagram useful in explaining operation of wave branching of the rotary joint according to the first embodiment of the present invention.

Here, for the electric wave H, each of vertical sidewall intervals of the rectangular branch waveguides 2*c* and 2*d* is designed so as to be equal to or smaller than a half of the free-space wavelength of the used frequency band. Thus, the electric wave H hardly leaks to the sides of the terminals P31 and P32 due to these cut-off effects. In addition, as shown in FIG. 6, since a direction of an electric field can be changed along the metallic block 4 and the short-circuit plate 3, there is provided the electric field distribution in a state in which two rectangular waveguide E-plane miter bends which are excellent in reflection characteristics are equivalently, symmetrically placed. As a result, the electric wave H inputted through the terminal P1 is efficiently outputted to the terminals P21 and P22 while suppressing the reflection to the terminal P1 and the leakage to the terminals P31 and P32.

Moreover, for the circular-square waveguide step 9, the stepped portion thereof is designed so as to be much smaller than the free-space wavelength of the used frequency band. For this reason, with respect to the reflection characteristics thereof, a reflection loss is large in the frequency band in the vicinity of a cut-off frequency of the basic mode of the electric wave H, while it is very small in the high frequency band higher than the cut-off frequency to some extent. This is similar to the reflection characteristics of the above-mentioned branch portion. Consequently, the circular-square waveguide step 9 is installed in the position where a reflected wave from the branch portion and a reflected wave due to the circular-square waveguide step 9 cancel each other in the vicinity of the cut-off frequency, whereby the degradation of the reflection characteristics due to the frequency band in the vicinity of the cut-off frequency can be suppressed without injuring the excellent reflection characteristics in the frequency band higher than the cut-off frequency of the basic mode of the electric wave H to some extent.

On the other hand, assuming that the vertically polarized electric wave V of the basic mode (TE10-mode) is inputted through the terminal P1, this electric wave is propagated through the circular-square waveguide step 9, the square main waveguide 1, and the rectangular branch waveguides 2*c* and 2*d* to be outputted as the electric wave of the basic mode (TE10-mode) in each branch waveguide through the terminals P31 and P32.

Here, for the electric wave V, each of vertical sidewall intervals of the rectangular branch waveguides 2*a* and 2*b* is designed so as to be equal to or smaller than a half of the free-space wavelength of the used frequency band. Thus, the electric wave V hardly leaks to the sides of the terminals P21 and P22 due to these cut-off effects. In addition, similarly to the case of the electric wave H, since a direction of the electric field can be changed along the metallic block 4 and the short-circuit plate 3, there is provided the electric field distribution in a state in which two rectangular waveguide E-plane miter bends which are excellent in reflection characteristics are equivalently, symmetrically placed. As a result, the electric wave V inputted through the terminal P1 is efficiently outputted to the terminals P31 and P32 while suppressing the reflection to the terminal P1 and the leakage to the terminals P21 and P22.

Moreover, for the circular-square waveguide step 9, the stepped portion thereof is designed so as to be much smaller than the free-space wavelength of the used frequency band. For this reason, with respect to the reflection characteristics thereof, a reflection loss is large in the frequency band in the vicinity of the cut-off frequency of the basic mode of the electric wave V, while it is very small in the frequency band higher than the cut-off frequency to some extent. This is similar to the reflection characteristics of the above-mentioned branch portion. Consequently, the circular-square waveguide step 9 is installed in the position where a reflected wave from the branch portion and a reflected wave due to the circular-square waveguide step 9 cancel each other in the vicinity of the cut-off frequency, whereby the degradation of the reflection characteristics due to the frequency band in the vicinity of the cut-off frequency can be suppressed without injuring the excellent reflection characteristics in the frequency band higher than the cut-off frequency of the basic mode of the electric wave V to some extent.

The above-mentioned operation principles have been described with reference to the case where the terminal P1 is set as an input terminal, and the terminals P21 to P32 are set as output terminals. However, the above-mentioned operation principles are applied to a case as well where the terminals P21 to P32 are set as input terminals, the terminal P1 is set as an output terminal, input waves inputted through the terminals P21 and P22 are made 180 degrees out of phase with each other, and are made equal in amplitude to each other, and input waves inputted through the terminals P31 and P32 are made 180 degrees out of phases with each other and are made equal in amplitude to each other.

Next, description will hereinbelow be given with respect to the operation of the polarizer of FIG. 3 using the above-mentioned construction of FIG. 2. In FIG. 3, assuming that the horizontally polarized electric wave H of the basic mode (TE01-mode) is inputted through the terminal P1, this electric wave is propagated through the circular-square waveguide step 9, the square main waveguide 1, the rectangular branch waveguides 2*a* and 2*b*, and the rectangular waveguide multistage transformers 11*a* and 11*b* to be composed in the rectangular waveguide E-plane T-branch circuit 12*a* again to be outputted as the electric wave of the basic mode (TE10-mode) in each branch waveguide through the terminal P2.

Here, for the electric wave H, each of the vertical sidewall intervals of the rectangular branch waveguides 2*c* and 2*d* is designed so as to be equal to or smaller than a half of the free-space wavelength of the used frequency band. Thus, the electric wave H hardly leaks to the sides of the rectangular waveguides 2*c* and 2*d* due to these cut-off effects. In addition, as shown in FIG. 6, since a direction of the electric field can be changed along the metallic block 4 and the short-circuit plate 3, there is provided the electric field distribution in a state in which two rectangular waveguide E-plane miter bends which are excellent in reflection characteristics are equivalently, symmetrically placed. As a result, the electric wave H inputted through the terminal P1 is efficiently outputted to the rectangular waveguides 2*a* and 2*b* while suppressing the reflection to the terminal P1 and the leakage to the rectangular waveguides 2*c* and 2*d*.

Moreover, for the circular-square waveguide step 9, the stepped portion thereof is designed so as to be much smaller than the free-space wavelength of the used frequency band. For this reason, with respect to the reflection characteristics thereof, a reflection loss is large in the frequency band in the vicinity of the cut-off frequency of the electric wave H of the basic mode, while it is very small in the high frequency band higher than the cut-off frequency to some extent. This is similar to the reflection characteristics of the above-mentioned branch portion. Consequently, the circular-square waveguide step 9 is installed in the position where a reflected wave from the branch portion and a reflected wave due to the circular-square waveguide step 9 cancel each other in the vicinity of the cut-off frequency, whereby the degradation of the reflection characteristics due to the frequency band in the vicinity of the cut-off frequency can be suppressed without injuring the excellent reflection characteristics in the frequency band higher than the cut-off frequency of the electric wave H of the basic mode to some extent.

Furthermore, the rectangular waveguide multistage transformers 11*a* and 11*b* are curved with the tube axes thereof, and have a plurality of stepped portions provided on the upper sidewalls thereof, and also each of intervals of the stepped portions is made about ¼ of a guide wavelength with respect to a waveguide central line. Thus, finally, the electric waves in the rectangular branch waveguides 2*a* and 2*b* which are obtained by separating the electric wave H thereinto can be composed in the rectangular waveguide E-plane T-branch circuit 12*a* to be efficiently outputted to the terminal P2 without injuring the reflection characteristics.

On the other hand, assuming that the vertically polarized electric wave V of a basic mode (TE10-mode) is inputted through the terminal P1, this electric wave is propagated through the circular-square waveguide step 9, the square main waveguide 1, the rectangular branch waveguides 2*b* and 2*d*, and the rectangular waveguide multistage transformers 11*c* and 11*d* to be composed in the rectangular waveguide E-plane T-branch circuit 12*b* again to be outputted as the electric wave of the basic mode (TE10-mode) in each branch waveguide through the terminal P3.

Here, for the electric wave V, each of the vertical sidewall intervals of the rectangular branch waveguides 2*a* and 2*b* is designed so as to be equal to or smaller than a half of the free-space wavelength of the used frequency band. Thus, the electric wave V hardly leaks to the sides of the rectangular waveguides 2*a* and 2*b* due to these cut-off effects. In addition, similarly to the case of the electric wave H, since a direction of the electric field can be changed along the metallic block 4 and the short-circuit plate 3, there is provided the electric field distribution in a state in which two rectangular waveguide E-plane miter bends which are excellent in reflection characteristics are equivalently, symmetrically placed. As a result, the electric wave V inputted through the terminal P1 is efficiently outputted to the rectangular waveguides 2*c* and 2*d* while suppressing the reflection to the terminal P1 and the leakage to the rectangular waveguides 2*a* and 2*b*.

Moreover, for the circular-square waveguide step 9, the stepped portion thereof is designed so as to be much smaller than the free-space wavelength of the used frequency band. For this reason, with respect to the reflection characteristics thereof, a reflection loss is large in the frequency band in the vicinity of the cut-off frequency of the electric wave V of the basic mode, while it is very small in the high frequency higher than the cut-off frequency to some extent. This is similar to the reflection characteristics of the above-mentioned branch portion. Consequently, the circular-square waveguide step 9 is installed in the position where a reflected wave from the branch portion and a reflected wave due to the circular-square waveguide step 9 cancel each other in the vicinity of the cut-off frequency, whereby the degradation of the reflection characteristics due to the frequency band in the vicinity of the cut-off frequency can be suppressed without injuring the excellent reflection characteristics in the frequency band higher than the cut-off frequency of the electric wave V of the basic mode to some extent.

Furthermore, the rectangular waveguide multistage transformers 11*c* and 11*d* are curved with the tube axes thereof, and have a plurality of stepped portions provided on the lower sidewalls thereof, and also each of intervals of the stepped portions is made about ¼ of a guide wavelength with respect to a waveguide central line. Thus, finally, the electric waves in the rectangular branch waveguides 2*c* and 2*d* which are obtained by separating the electric wave V thereinto can be composed in the rectangular waveguide E-plane T-branch circuit 12*b* so as to avoid interference with the rectangular waveguide multistage transformers 11*a* and 11*b*, and the rectangular waveguide E-plane T-branch circuit 12*a* to be efficiently outputted to the terminal P3 without injuring the reflection characteristics.

The above-mentioned operation principles have been described with respect to the case where the terminal P1 is set as an input terminal, and the terminals P2 and P3 are set as output terminals. However, the above-mentioned operation principles are applied to a case as well where the terminals P2 and P3 are set as input terminals, and the terminal P1 is set as an output terminal.

Moreover, description will hereinbelow be given with respect to the operation of the circular waveguide rotation portion of FIG. 5. In FIG. 5, after an electric wave made incident through the terminal P1 has been propagated in the form of a circular waveguide TE11-mode through the circular waveguide 13, it is transmitted to the circular waveguide 14 through the connection portion 17 to be guided to the terminal P4. At this time, even when the circular waveguide 14 is rotated about a common tube axis as the axis with respect to the circular waveguide 13, no degradation of the characteristics due to reflection or the like is caused with assistance of a function of the connection portion 17. In such a manner, the circular waveguide rotation portion 23 shown in FIG. 5 has a function of guiding an input signal inputted through the terminal P1 to the terminal P4 irrespective of presence or absence of rotation of the circular waveguide 14.

The operations of the respective portions in FIG. 1 have been described. The operation of the whole rotary joint will hereinbelow be described with reference to FIG. 1. After two electric waves which are in phase with each other, but have respective amplitudes have been made incident through the terminals P2 and P3, respectively, these electric waves are composed from the form of two orthogonal polarized waves in the inside of the polarizer 21 so that a composite wave of a circular waveguide TE11-mode having a polarized wave angle depending on an amplitude ratio of these two electric waves is guided to the terminal P1. After the composite wave has been transmitted through the circular waveguide rotation portion 23, it is separated into the two orthogonal polarized waves again in the polarizer 22 which are in turn distributively outputted to the terminals P5 and P6, respectively.

Here, when the circular waveguide 14 and the polarizer 22 are mechanically connected to each other to be simultaneously rotated, a polarized wave angle of the polarized wave of the circular waveguide TE11-mode guided to the polarizer 22 is changed in accordance with an angle of rotation of the circular waveguide 14, and the amplitudes of the electric waves guided to the terminals P5 and P6, respectively, are changed accordingly. At this time, no reflection is caused in the polarizer 22 and the circular waveguide rotation portion 23.

On the other hand, after two electric waves which are 90 degrees out of phase with each other, but are equal in amplitude to each other have been made incident through the terminals P2 and P3, respectively, these electric waves are composed from the form of two orthogonal polarized waves in the inside of the polarizer 21 into a circularly polarized wave of the circular waveguide TE11-mode which is in turn guided to the terminal P1. After this composite wave has been transmitted through the circular waveguide rotation portion 23, it is separated into the two orthogonal polarized waves again in the polarizer 22 which are in turn distributively outputted to the terminals P5 and P6, respectively.

Here, when the circular waveguide 14 and the polarizer 22 are mechanically connected to each other to be simultaneously rotated, due to the axial symmetrical property of the circularly polarized wave, two electric waves which are 90 degrees out of phase with each other and which are equal in amplitude to each other are distributively outputted to the terminals P5 and P6, respectively, without being reflected in the polarizer 22 and the circular waveguide rotation portion 23 irrespective of presence or absence of rotation of the circular waveguide 14 and the polarizer 22.

Consequently, the invention of the first embodiment shown in FIGS. 1 to 6 has a function as a two-channel rotary joint which is capable of simultaneously transmitting two different signals.

As described above, the rotary joint according to the first embodiment has an effect and a superior advantage in that the rotary joint is of a thin type and has broad band characteristics since the polarizers 21 and 22 can be constructed so as to be of a thin type and to have the broad band, and also a circularly polarized wave generating portion is unnecessary which has a long axial length and a relatively narrow frequency band. In addition, the rotary joint has a superior advantage in that since the rotary joint is constructed with only the waveguides, it is low in loss and is excellent in power resistance as well.

Note that, in the first embodiment of the present invention, the description has been given with respect to the case where in FIG. 2, the square main waveguide is used as the waveguide which transmits therethrough the vertically polarized wave and the horizontally polarized electric wave. However, even if a circular waveguide is used, the same effects can be obtained.

In addition, while in the first embodiment of the present invention, the description has been given with respect to the case where the circular waveguide is used in FIG. 5, even if a square waveguide is used, the same effects can be obtained.

Figure 7:
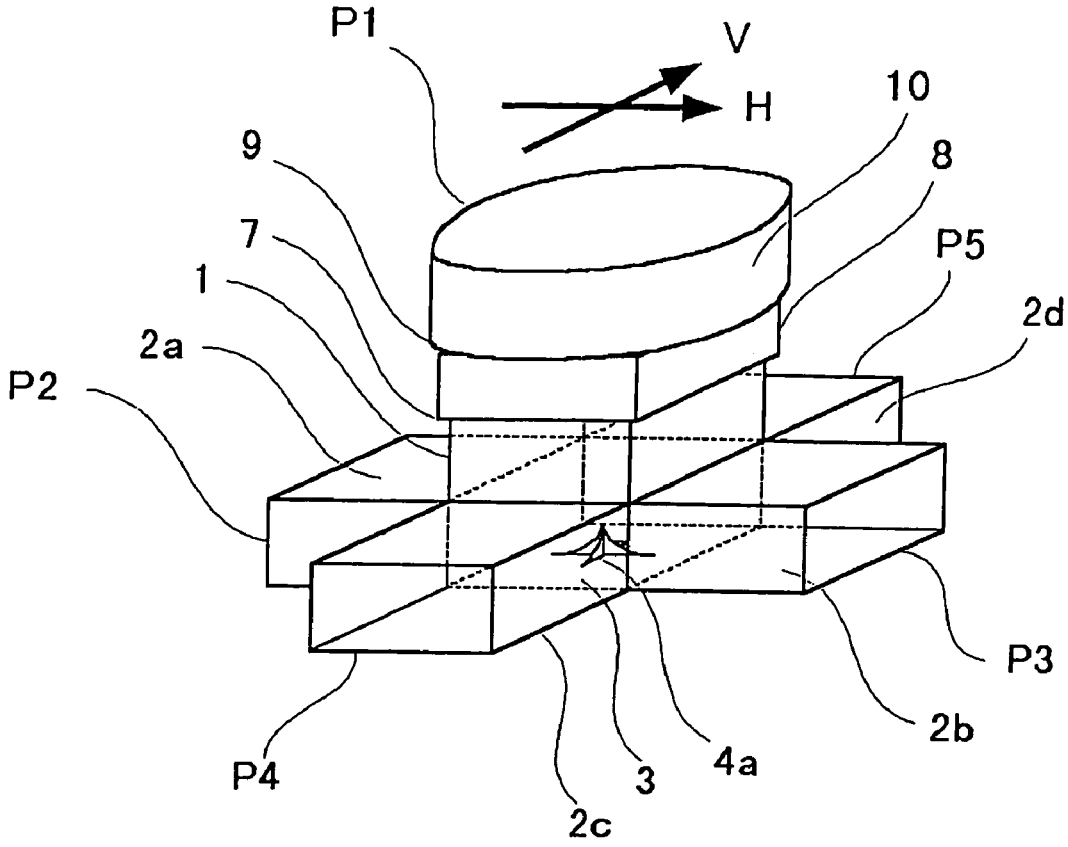
FIG. 7 is a perspective view showing a part of the rotary joint according to the first embodiment of the present invention.

In addition, in the first embodiment of the present invention, the description has been given with respect to the case where the quadratic spindle-shaped metallic block 4 is provided in order to change a direction of the electric field as shown in FIG. 6. However, the present invention is not intended to be limited thereto as long as such a construction as to change a direction of an electric field as shown in FIG. 6 is adopted. Thus, even if a metallic block having a step-shaped or circular cutout is provided, the same effects can be obtained. Furthermore, even if two sheets of thin metallic plates 4*a* each having a circular cutout as shown in FIG. 7 are provided, the same effects can be obtained. Even if two sheets of thin metallic plates each having a linear or step-shaped cutout are provided so as to be perpendicularly intersect each other, the same effects can be obtained.

In addition, in the first embodiment of the present invention, the description has been given with respect to the case where there is used the circular-square waveguide step 9 which is connected to one terminal of the square main waveguide 1, and an opening diameter of which becomes narrower towards the above-mentioned branch portion, and also a stepped portion of which is much smaller than the free-space wavelength of the used frequency band. However, even if there is used a circular-square waveguide step an opening diameter of which is increased towards the above-mentioned branch portion.

SECOND EMBODIMENT 2

Figure 8:
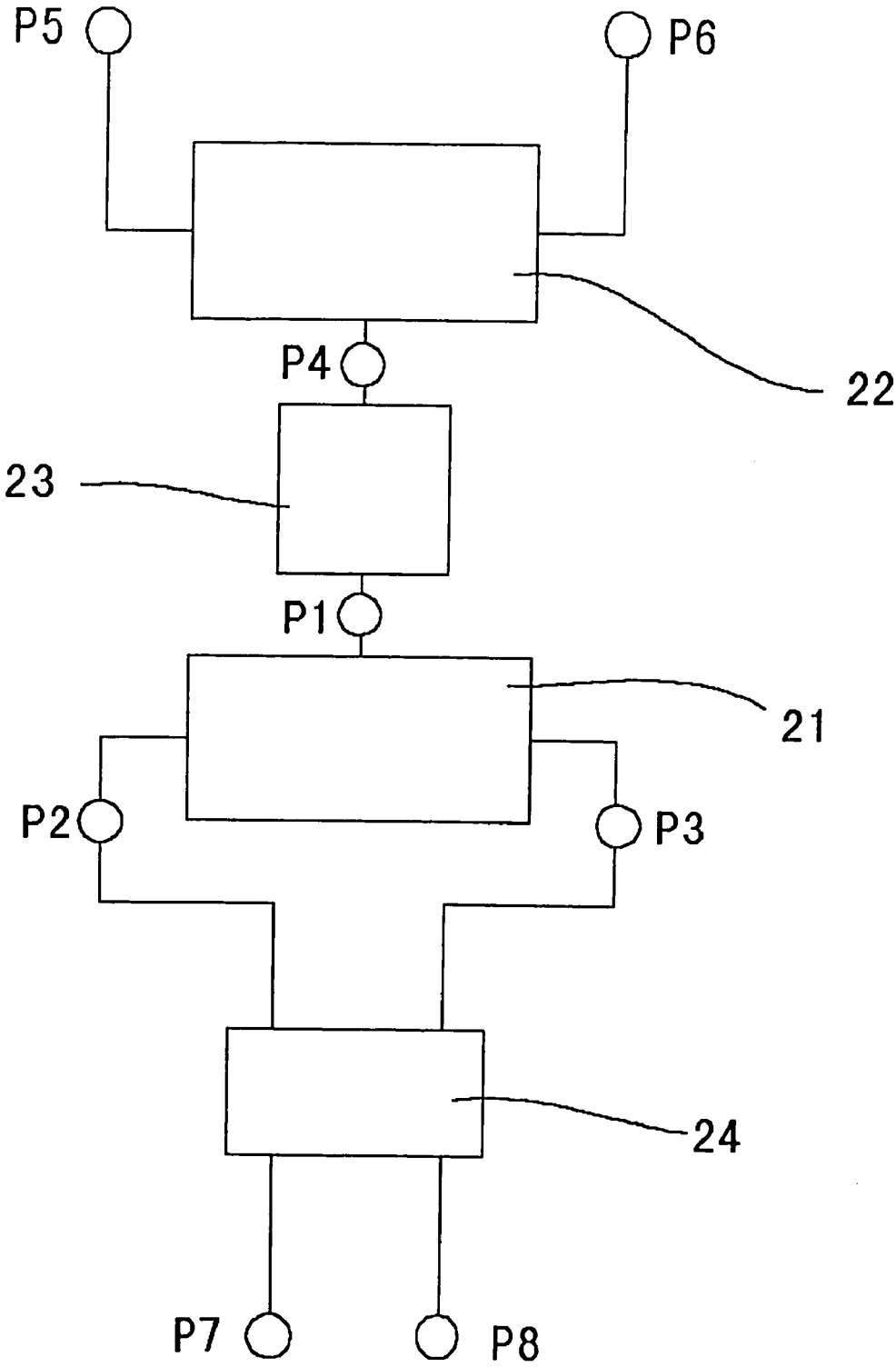
FIG. 8 is a structural view of a rotary joint according to a second embodiment of the present invention.

In a second embodiment of the present invention, description will hereinbelow be given with respect to a case where a hybrid is added to the rotary joint of the above-mentioned first embodiment. FIG. 8 is a structural view of a rotary joint according to the second embodiment of the present invention. In FIG. 8, reference numeral 24 designates a 90 degrees hybrid, and reference symbols P7 and P8 respectively designate terminals. Then, when the terminal P7 is set as an incidence terminal, the terminal P8 becomes an isolation terminal, and other two distribution terminals are connected to branch side terminals P2 and P3 of a first polarizer 21, respectively. Other constituent elements identical to those in the first embodiment are designated with the same reference numerals as those of the first embodiment shown in FIG. 1.

The operation will hereinbelow be described. An electric wave made incident through the terminal P7 is distributed in the form of two electric waves which are 90 degrees out of phase with each other and which are equal in amplitude to each other by the 90 degrees hybrid 24 to the terminals P2 and P3, respectively. These electric waves obtained through the distribution are composed in the form of a circularly polarized wave in the polarizer 21. Thus, the composite wave is guided to the polarizer 22 to be redistributed in the form of two electric waves which are 90 degrees out of phase with each other and which are equal in amplitude to each other irrespective of an angle of rotation of the circular waveguide rotation portion 23 to the terminals P5 and P6, respectively.

As described above, the rotary joint according to the second embodiment of the present invention has the same function, effects and superior advantage as those of the invention of the above-mentioned first embodiment, and in addition thereto, has an effect and a superior advantage in that two electric waves can be transmitted irrespective of an angle of rotation of the circular waveguide rotation portion 23.

THIRD EMBODIMENT

Figure 9:
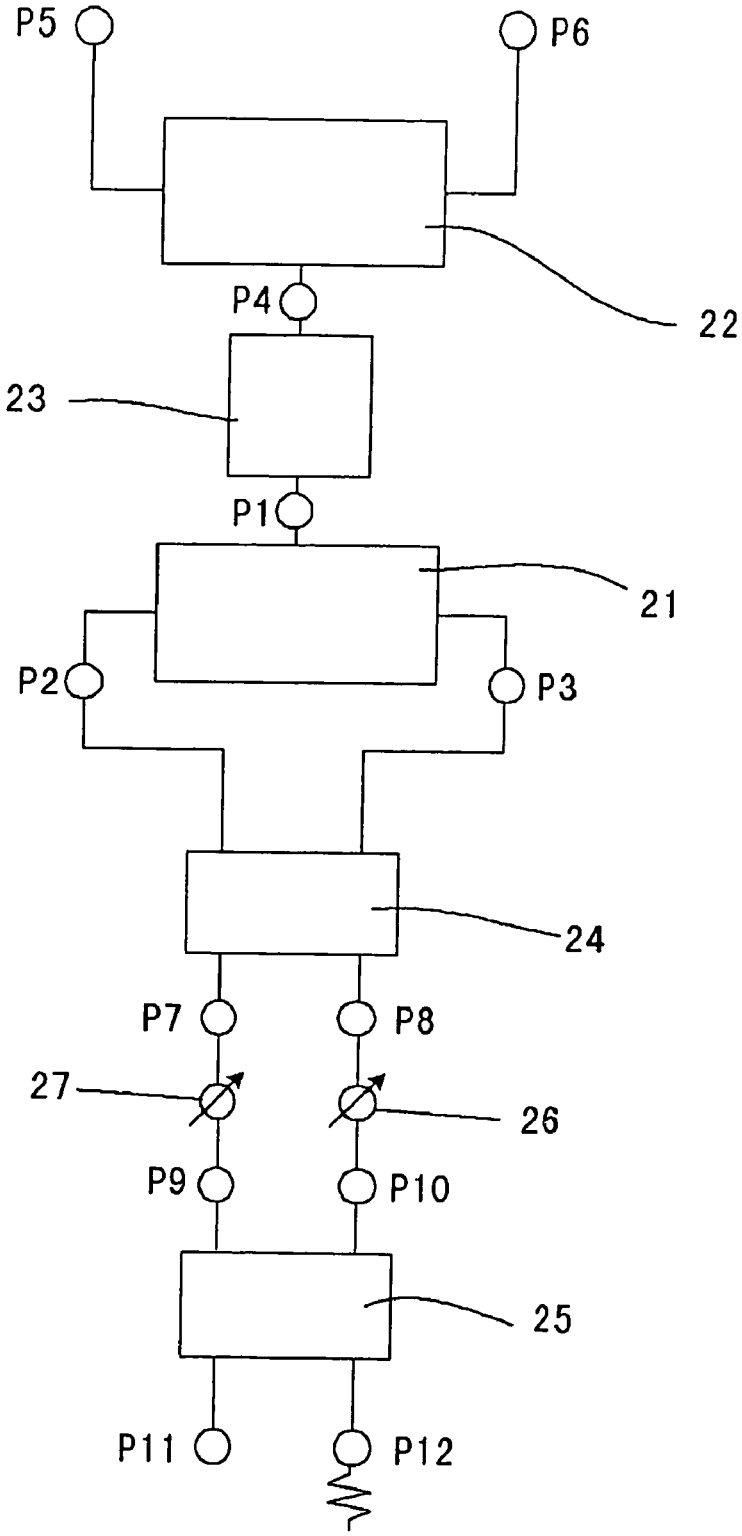
FIG. 9 is a structural view of a rotary joint according to a third embodiment 3 of the present invention.

In a third embodiment of the present invention, description will hereinbelow be given with respect to a case where a 90-degrees hybrid and phase shifters are added to the rotary joint of the above-mentioned second embodiment. FIG. 9 is a structural view of a rotary joint according to the third embodiment of the present invention. In FIG. 9, reference numeral 25 designates a 90 degrees hybrid, reference numerals 26 and 27 respectively designate phase shifters, and reference symbols P9 to P12 respectively designate terminals. Other constituent elements identical to those in the second embodiment are designated with the same reference numerals as those of the above-mentioned second embodiment.

Operation will hereinbelow be described. The 90 degrees hybrids 24 and 25, and the phase shifters 26 and 27 constitute a variable power distributor which is commonly used. An electric wave made incident through the terminal P11 is changed so that absolute values of quantities of phase shift in both the phase shifters become equal to each other with a passage phase in the phase shifter 26 falling within the range of 0 degree to −90 degrees and with a passage phase in the phase shifter 27 falling within the range of 0 degree to +90 degrees, whereby it is distributed in the form of two electric waves which are in phase with each other and which have an arbitrary distribution ratio to the terminals P7 and P8, respectively. Thus, an angle of the polarized wave of a circular waveguide TE11-mode which is obtained through the composition in the polarizer 21 is adjusted by changing quantities of phase shift of the phase shifters 26 and 27 in accordance with an angle of rotation by the circular waveguide rotation portion 23, whereby the two electric waves which are in phase with each other and which have an arbitrary amplitude ratio are guided to the terminals P5 and P6, respectively.

As described above, the rotary joint according to the third embodiment of the present invention has the same function, effects and superior advantage as those of the invention of the above-mentioned first embodiment, and in addition thereto, has an effect and a superior advantage in that the electric wave can be redistributed or recomposed with an equal phase being held and at an arbitrary distribution ratio in upper and lower portions of the circular waveguide rotation portion 23.

FOURTH EMBODIMENT

In a fourth embodiment of the present invention, description will hereinafter be given with respect to a case where a square waveguide step and a square waveguide are used instead of the circular-square waveguide step 9 and the circular waveguide 10 in the rotary joint of the above-mentioned first embodiment.

Figure 10:
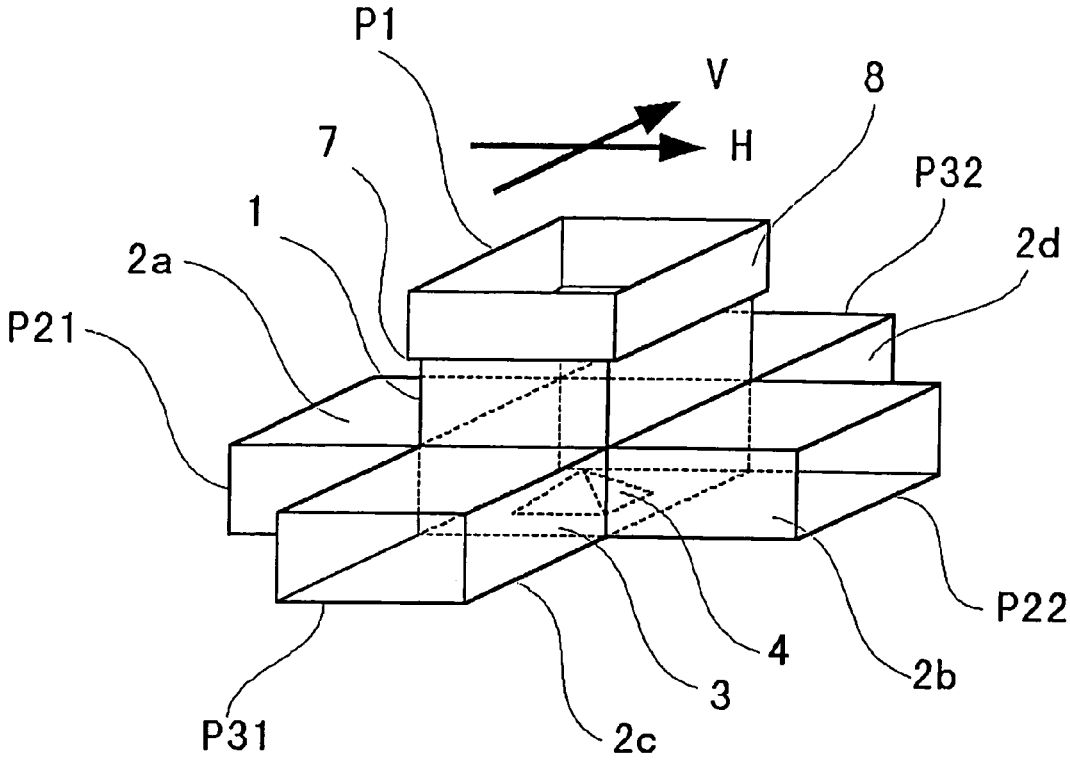
FIG. 10 is a constructional view showing a part of a rotary joint according to a fourth embodiment of the present invention.

FIG. 10 is a structural view showing a part of a rotary joint according to the fourth embodiment of the present invention. In FIG. 10, reference numeral 7 designates a square waveguide step, and reference numeral 8 designates a square waveguide. Other constituent elements identical to those in the first embodiment are designated with the same reference numerals as those of the first embodiment shown in FIG. 1.

The rotary joint according to the fourth embodiment of the present invention has the same operation principles, function, effects and superior advantage as those of the invention of the above-mentioned first embodiment, and in addition thereto, has an effect and a superior advantage in that a range of impedance matching as a polarizer is extended since the waveguide step is different in shape and also is different in reflection amplitude phase by using the square waveguide step 7 and the square waveguide 8.

Note that, while in the fourth embodiment of the present invention, the description has been given with respect to the case where the square waveguide step 7 and the square waveguide 8 are used, a circular waveguide step and a circular waveguide may also be used.

FIFTH EMBODIMENT

In a fifth embodiment of the present invention, description will hereinbelow be given with respect to a case where a square waveguide step and a square waveguide are further added to the portions as the circular-square waveguide step 9 and the circular waveguide 10 in the rotary joint of the above-mentioned first embodiment.

Figure 11:
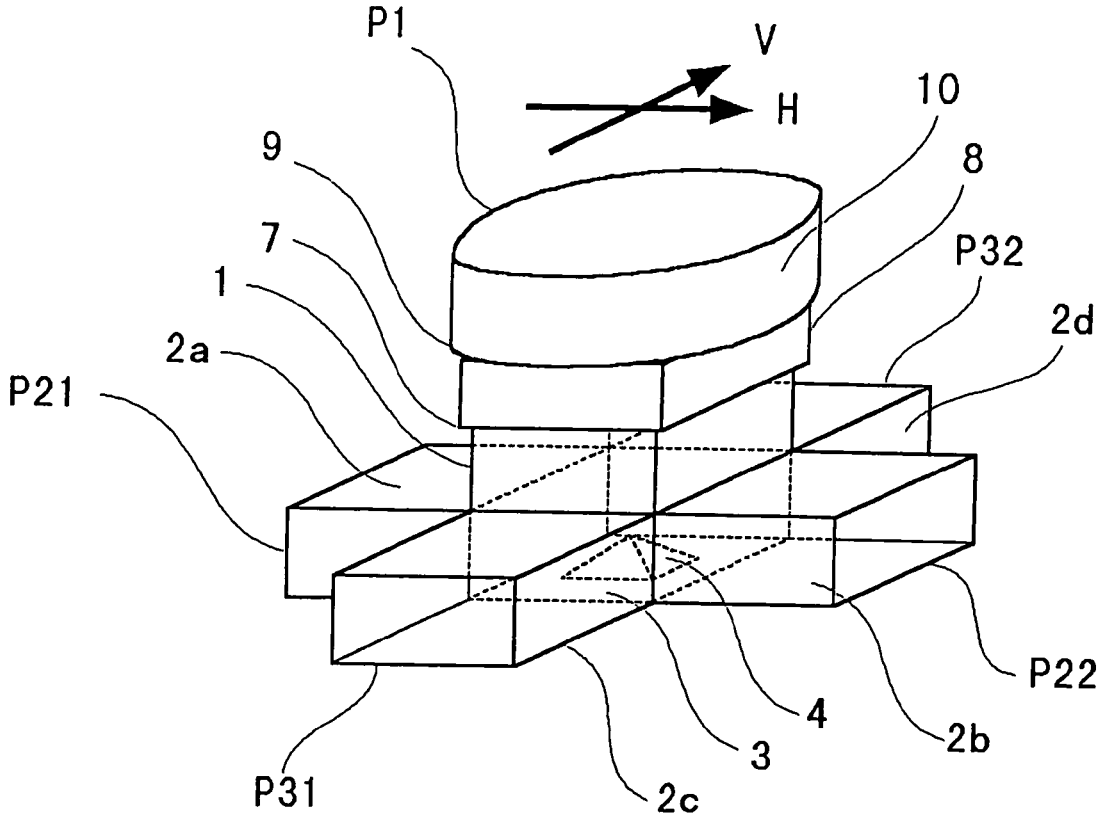
FIG. 11 is a constructional view showing a part of a rotary joint according to a fifth embodiment of the present invention.
Figure 12:
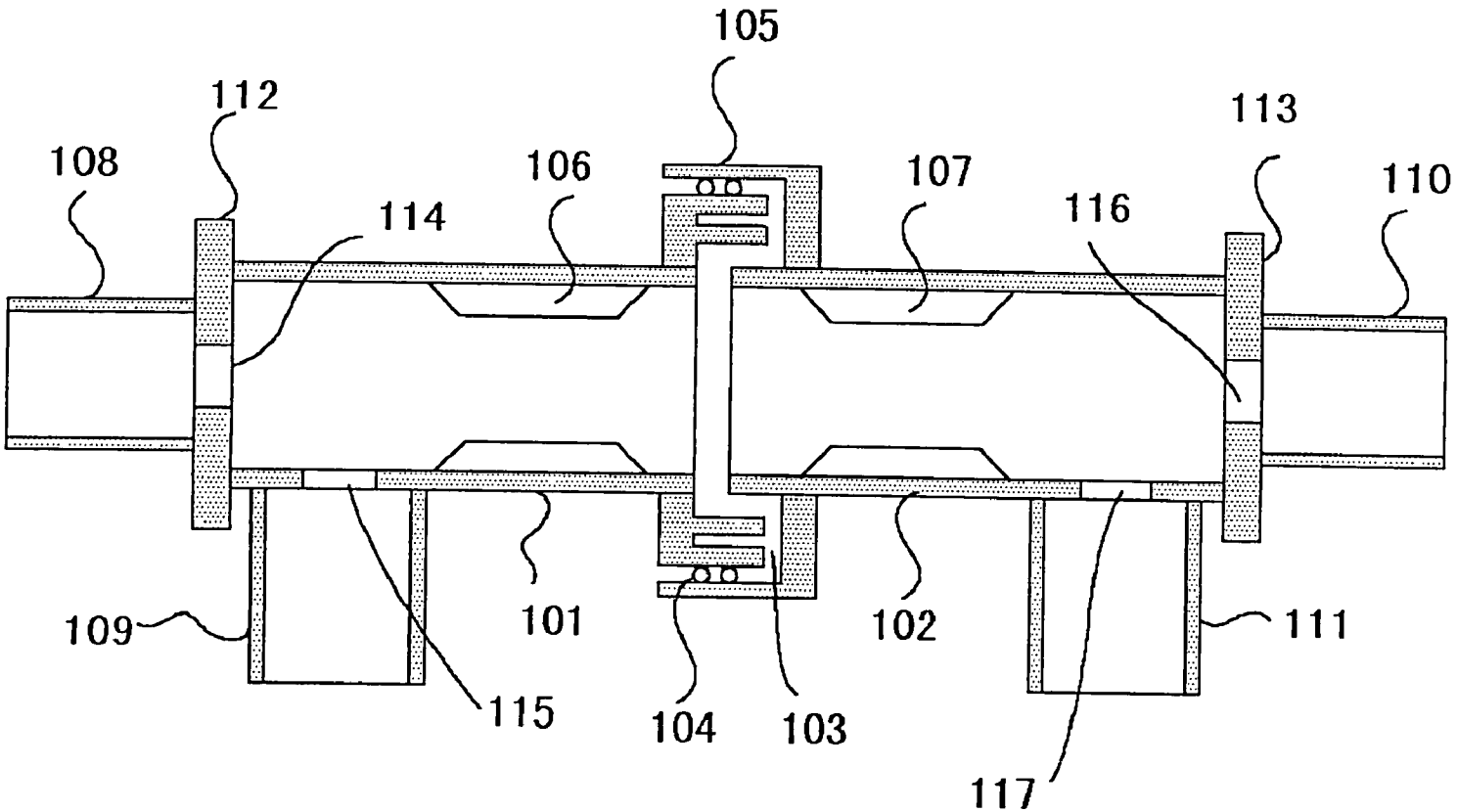
FIG. 12 is a plan view showing a construction of a conventional rotary joint.

FIG. 11 is a structural view showing a part of a rotary joint according to the fifth embodiment of the present invention. In FIG. 11, reference numeral 7 designates a square waveguide step which is connected to one terminal of the first square main waveguide 1, and an opening diameter of which becomes smaller towards a branch portion; reference numeral 8 designates a second square main waveguide which is connected to the square waveguide step 7 and through which a vertically polarized electric wave and a horizontally polarized electric wave are transmitted; reference numeral 9 designates a circular-square waveguide step connected to the second square main waveguide 8; and reference numeral 10 designates a circular main waveguide which is connected to the circular-square waveguide step 9, and through which a vertically polarized electric wave and a horizontally polarized electric wave are transmitted. Other constituent elements identical to those of the first embodiment are designated with the same reference numerals as those of the above-mentioned first embodiment.

In the rotary joint according to the fifth embodiment of the present invention, the circular-square waveguide step 9, the square main waveguide 8, and the square waveguide step 7 are operated in the form of a circular-square waveguide multistage transformer. Thus, a diameter of the circular main waveguide 10, a diameter of the square main waveguide 8, and a tube axis length of the square main waveguide 8 are suitably designed, whereby the rotary joint according to the fifth embodiment of the present invention has the same function, effects and superior advantage as those of the invention of the above-mentioned first embodiment, and in addition thereto, has an effect and a superior advantage in that broad band impedance matching is obtained.

As set forth hereinabove, according to the rotary joint of the present invention, the rotary joint includes first and second polarizers each having a common side terminal and two branch side terminals through which two polarized waves orthogonal to each other inputted through the common side terminal are separately taken out, and a circular or square waveguide portion which has a rotatable connection portion, one end of which is connected to the common side terminal of the first polarizer, and the other end of which is connected to the common side terminal of the second polarizer, whereby there is offered an effect that the rotary joint is of a thin type and has broad band characteristics.

In addition, the rotary joint includes a 90 degrees hybrid having first to fourth terminals, and then the second terminal of the 90 degrees hybrid is connected to one branch side terminal of the first polarizer, and the third terminal of the 90 degrees hybrid is connected to the other branch side terminal of the first polarizer, whereby two electric waves can be transmitted independently of an angle of rotation of the rotatable connection portion of the circular or square waveguide.

In addition, the rotary joint includes first and second 90 degrees hybrids each having first to fourth terminals, and first and second phase shifters, and then the second terminal of the first 90 degrees hybrid is connected to the third terminal of the second 90 degrees hybrid through the first phase shifter, the third terminal of the first 90 degrees hybrid is connected to the second terminal of the second 90 degrees hybrid through the second phase shifter, the first terminal of the second 90 degrees hybrid is connected to one branch side terminal of the first polarizer, and the fourth terminal of the second 90 degrees hybrid is connected to the other branch side terminal of the first polarizer, whereby an electric wave can be redistributed or recomposed with an equal phase being held and at an arbitrary distribution ratio in upper and lower portions of the rotatable connection portion of the circular or square waveguide.

In addition, since the circular or square waveguide portion has a cross sectional size with which only an electric wave of a circular waveguide TE11-mode or a square waveguide TE10-mode can be propagated, there is offered an effect in that the rotary joint is of a thin type and has broad band characteristics.

Moreover, since the connection portion of the circular or square waveguide portion includes a choke construction and a rotation mechanism which are formed from a sidewall of the circular or square waveguide portion towards the outside, there is offered an effect in that the rotary joint is of a thin type and has broad band characteristics.

Moreover, in the 90 degrees hybrid, the first terminal is an input terminal, second and third terminals are distribution terminals, and the fourth terminal is an isolation terminal, and then a passage phase of an electric wave from the first terminal to the second terminal and a passage phase of an electric wave from the first terminal to the third terminal have a relative difference of about 90 degrees, and a passage phase of the electric wave from the fourth terminal to the second terminal and a passage phase of the electric wave from the fourth terminal to the third terminal also have a relative difference of about 90 degrees, whereby two electric waves can be transmitted independently of an angle of rotation of the rotatable connection portion of the circular or square waveguide.

Moreover, the polarizer includes: a first main waveguide having a circular or square cross section; a first to fourth rectangular branch waveguides each of which branches nearly perpendicularly to the first main waveguide; a short-circuit plate connected to one terminal of the first main waveguide; a metallic projection provided on the short-circuit plate; one waveguide step which is connected to the other terminal of the first main waveguide and an opening diameter of which becomes narrower towards the branch waveguide side; and a second main waveguide having a circular or square cross section and connected to the waveguide step, whereby there is offered an effect in that the rotary joint is of a thin type and has broad band characteristics.

Also, the polarizer includes: a first main waveguide having a square cross section; first to fourth rectangular branch waveguides each of which branches nearly perpendicularly to the first main waveguide; a short-circuit plate connected to one terminal of the first main waveguide; a metallic projection provided on the short-circuit plate; one circular-square waveguide step connected to the other terminal of the first main waveguide; and a second main waveguide having a circular cross section and connected to the circular-square waveguide step, whereby there is offered an effect in that the rotary joint is of a thin type and has broad band characteristics.

Also, the polarizer includes: a first main waveguide having a circular or square cross section; first to fourth rectangular branch waveguides each of which branches nearly perpendicularly to the first main waveguide; a short-circuit plate connected to one terminal of the first main waveguide; a metallic projection provided on the short-circuit plate; one waveguide step which is connected to the other terminal of the first main waveguide and an opening diameter of which is increased towards the branch waveguide side; and a second main waveguide having a circular or square cross section and connected to the waveguide step, whereby there is offered an effect in that the rotary joint is of a thin type and has broad band characteristics.

Also, the polarizer includes: a first main waveguide having a square cross section; first to fourth rectangular branch waveguides each of which branches nearly perpendicularly to the first main waveguide; a short-circuit plate connected to one terminal of the first main waveguide; a metallic projection provided on the short-circuit plate; one square waveguide step which is connected to the other terminal of the first main waveguide and an opening of which is decreased towards the branch waveguide side; a second main waveguide having a square cross section and connected to the square waveguide step; one circular-square waveguide step connected to the second square main waveguide; and a third main waveguide having a circular cross section and connected to the circular-square waveguide step, whereby there is offered an effect in that broad band impedance matching is obtained.

In addition, a metallic block having one quadratic spindle-shaped or step-shaped or circular cutout is provided as the metallic projection, whereby there is offered an effect in that the rotary joint is of a thin type and has broad band characteristics.

In addition, two sheets of thin metallic plates each having a circular or linearly or step-shaped cutout are provided so as to be perpendicularly intersect each other as the metallic projection, whereby there is offered an effect in that the rotary joint is of a thin type and has broad band characteristics.

Also, the polarizer includes: a first rectangular waveguide multistage transformer which is connected to the first branch waveguide and which has a curved tube axis; a second rectangular waveguide multistage transformer which is connected to the second branch waveguide and which has a curved tube axis; a first rectangular waveguide E-plane T-branch circuit connected to the first and second rectangular waveguide multistage transformers; a third rectangular waveguide multistage transformer which is connected to the third branch waveguide and which has a curved tube axis; a forth rectangular waveguide multistage transformer which is connected to the fourth branch waveguide and which has a curved tube axis; and a second rectangular waveguide E-plane T-branch circuit connected to the third and fourth branch waveguides, whereby there is offered an effect in that the rotary joint is of a thin type and has broad band characteristics.

INDUSTRIAL APPLICABILITY

As set forth, according to the present invention, it is possible to provide the rotary joint which is of a thin type and has broad band characteristics, and which is low in loss and is excellent in power resistance as well.

The invention claimed is:

1. A rotary joint comprising:

first and second polarizers each having a common side terminal connected to a waveguide portion, and two branch side terminals through which two polarized waves orthogonal to each other inputted through the common side terminal are separately taken out; and the waveguide portion which has a rotatable connection portion, one end of which is connected to the common side terminal of the first polarizer and the other end of which is connected to the common side terminal of the second polarizer; and a 90 degrees hybrid having an input terminal, an isolation terminal, and two distribution terminals which are connected to the two branch side terminals of the first polarizer, respectively.

2. A rotary joint according to claim 1, characterized in that:

each of the common terminals of the first and second polarizers has a circular or rectangular waveguide cross sectional shape; and the waveguide portion is a circular or rectangular waveguide portion.

3. A rotary joint according to claim 2, characterized in that:

the waveguide portion has a cross section with which only an electric wave of a circular waveguide TE11-mode or a square waveguide TE10-mode can be propagated.

4. A rotary joint according to claim 1, characterized in that:

the 90 degrees hybrid is composed of a first 90 degrees hybrid;

the rotary joint, in addition to the first 90 degrees hybrid, further comprises a second 90 degrees hybrid having an input terminal, an isolation terminal, and two distribution terminals, and first and second phase shifters; and the input terminal of the first 90 degrees hybrid is connected to one distribution terminal of the second 90 degrees hybrid through the first phase shifter, and the isolation terminal of the first 90 degrees hybrid is connected to the other distribution terminal of the second 90 degrees hybrid through the second phase shifter.

5. A rotary joint according to claim 1, characterized in that:

the connection portion of the waveguide portion includes a choke construction and a rotation mechanism which are formed from a sidewall of the waveguide towards the outside.

6. A rotary joint according to claim 1, characterized in that:

the 90 degrees hybrid has a passage phase of an electric wave from the input terminal to one distribution terminal and a passage phase of an electric wave from the input terminal to the other distribution terminal with a relative difference of about 90 degrees, and a passage phase of the electric wave from the isolation terminal to the one distribution terminal and a passage phase of the electric wave from the isolation terminal to the other distribution terminal with a relative difference of about 90 degrees.

7. A rotary joint, comprising:

first and second polarizers each having a common side terminal connected to a waveguide portion, and two branch side terminals through which two polarized waves orthogonal to each other inputted through the common side terminal are separately taken out; and the waveguide portion which has a rotatable connection portion, one end of which is connected to the common side terminal of the first polarizer and the other end of which is connected to the common side terminal of the second polarizer;

each of the first and second polarizers includes: a first main waveguide; first to fourth rectangular branch waveguides each of which branches nearly perpendicularly to the first main waveguide; a short-circuit plate connected to one terminal of the first main waveguide; a metallic projection provided on the short-circuit plate; a waveguide step connected to the other terminal of the first main waveguide; and a second main waveguide connected to the waveguide step.

8. A rotary joint according to claim 7, characterized in that:

each of the first main waveguide and the second main waveguide has a circular or rectangular waveguide cross sectional shape; and the waveguide step is a circular or rectangular waveguide step.

9. A rotary joint according to claim 7, characterized in that:

an opening diameter of the waveguide step is decreased towards the branch waveguide side.

10. A rotary joint according to claim 7, characterized in that:

an opening diameter of the waveguide step is increased towards the branch waveguide side.

11. A rotary joint according to claim 7, characterized in that:

a metallic block having a quadratic spindle-shaped or step-shaped or circular cutout is provided as the metallic projection.

12. A rotary joint according to claim 7, characterized in that:

two sheets of thin metallic plates each having a circular or linear or step-shaped cutout are provided so as to be perpendicularly intersect each other as the metallic projection.

13. A rotary joint according to claim 7, characterized in that:

the polarizer includes: a first rectangular waveguide multistage transformer connected to the first branch waveguide and having a curved tube axis; a second rectangular waveguide multistage transformer connected to the second branch waveguide and having a curved tube axis; a first rectangular waveguide E-plane T-branch circuit connected to the first and second rectangular waveguide multistage transformers; a third rectangular waveguide multistage transformer connected to the third branch waveguide and having a curved tube axis; a fourth rectangular waveguide multistage transformer connected to the fourth branch waveguide and having a curved tube axis; and a second rectangular waveguide E-plane T-branch circuit connected to the third and fourth branch waveguides.

14. A rotary joint comprising:

first and second polarizers each having a common side terminal connected to a waveguide portion, and two branch side terminals through which two polarized waves orthogonal to each other inputted through the common side terminal are separately taken out; and the waveguide portion which has a rotatable connection portion, one end of which is connected to the common side terminal of the first polarizer and the other end of which is connected to the common side terminal of the second polarizer;

each of the first and second polarizers includes: a first main waveguide; first to fourth rectangular branch waveguides each of which branches nearly perpendicularly to the first main waveguide; a short-circuit plate connected to one terminal of the first main waveguide; a metallic projection provided on the short-circuit plate; a waveguide step connected to the other terminal of the first main waveguide; and a second main waveguide connected to the waveguide step; and the waveguide step is composed of a first waveguide step;

the rotary joint, in addition to the first waveguide step, further comprises a second waveguide step connected to the second main waveguide, and a third main waveguide connected to the second waveguide step.

15. A rotary joint according to claim 14, characterized in that:

each of the first main waveguide and the second main waveguide has a rectangular waveguide cross sectional shape;

the third main waveguide has a circular waveguide cross sectional shape;

the first waveguide step is a rectangular waveguide step; and the second main waveguide is a circular-rectangular waveguide step.

* * * * *